US010792684B2

(12) United States Patent
Decock et al.

(10) Patent No.: US 10,792,684 B2
(45) Date of Patent: Oct. 6, 2020

(54) SYSTEM HAVING FRANGIBLE BRIDGES

(71) Applicant: Nemera La Verpillière S.A.S., La Verpilliere (FR)

(72) Inventors: Thierry Decock, Lyons (FR); Gaëtan Painchaud, Francheville (FR)

(73) Assignee: Nemera La Verpillière (FR)

( * ) Notice: Subject to any disclaimer, the term of this patent is extended or adjusted under 35 U.S.C. 154(b) by 0 days.

(21) Appl. No.: 16/083,726

(22) PCT Filed: Feb. 21, 2017

(86) PCT No.: PCT/FR2017/050380
§ 371 (c)(1),
(2) Date: Sep. 10, 2018

(87) PCT Pub. No.: WO2017/153655
PCT Pub. Date: Sep. 14, 2017

(65) Prior Publication Data

US 2019/0126302 A1 May 2, 2019

(30) Foreign Application Priority Data

Mar. 9, 2016 (FR) ..... 16 51966

(51) Int. Cl.
*B05B 11/00* (2006.01)
*B05B 15/30* (2018.01)

(52) U.S. Cl.
CPC ..... *B05B 11/0008* (2013.01); *B05B 11/0037* (2013.01); *B05B 11/3045* (2013.01); *B05B 15/30* (2018.02); *B05B 11/3047* (2013.01)

(58) Field of Classification Search
CPC . B05B 15/30; B05B 11/0008; B05B 11/0037; B05B 11/3045; B05B 11/3047;
(Continued)

(56) References Cited

U.S. PATENT DOCUMENTS 5,238,152 A * 8/1993 Maas ..... B05B 11/3011 215/274
5,297,701 A * 3/1994 Steijns ..... B05B 11/0029 222/153.05

(Continued)

FOREIGN PATENT DOCUMENTS

FR 3021636 A1 12/2015
WO 9928205 A1 6/1999
WO 2007090998 A2 8/2007

*Primary Examiner* — Paul R Durand
*Assistant Examiner* — Andrew P Bainbridge
(74) *Attorney, Agent, or Firm* — St. Onge Steward Johnston & Reens, LLC

(57) ABSTRACT

An attached device for a threaded neck of a container, including a first ring provided with a thread which allows the first ring to be screwed onto a threaded neck of the container, and a second ring that rotates as one with the first ring with the aid of at least one coupling member which is separate from at least one of the first and second rings and includes at least one zone for coupling to the at least one first, second ring from which it is separate, the coupling member including a breaking zone separate from the coupling zone and intended to break starting at a threshold rotational torque applied between the first and second rings.

10 Claims, 4 Drawing Sheets

(58) Field of Classification Search
CPC ..... B65D 41/3409; B65D 41/3428; B65D 41/3438; B65D 41/3457; B65D 55/0863; B65D 55/0872; B65D 55/0881; B65B 61/186
USPC ..... 222/153.05–153.06, 153.09–153.1, 222/420–422; 215/201–202, 330; 53/470, 490, 410, 133.1–133.2
See application file for complete search history.

(56) References Cited

U.S. PATENT DOCUMENTS 6,367,641 B1 * 4/2002 Garcia ..... B05B 11/3049 215/330
8,939,302 B2 * 1/2015 Last ..... B65D 41/3447 215/252
9,669,974 B2 * 6/2017 Wochele ..... B65D 41/32

* cited by examiner

SYSTEM HAVING FRANGIBLE BRIDGES

FIELD OF THE INVENTION

The present invention concerns an attached device for a threaded neck of a container, more particularly an attached device comprising a pump for dispensing the fluid contained in the container.

BACKGROUND OF THE INVENTION

In known manner, there are offered, in trade, pharmaceutical products sold in bottles. Most of the time, these bottles comprise a threaded neck container onto which is screwed an attached device forming for example a dispensing pump.

A bottle of this kind has the two-fold advantage of enabling:

- easy filling of the container with no special tooling, and
- screwing a large number of attached devices of different types to different types of containers having the same type of threaded neck, thus offering great adaptability of the container to various existing devices.

At present, there exist, in the prior art, various principal standards for container threaded necks derived from the GCMI standard, used in particular for pharmaceutical products, to which standards the suppliers of attached devices must adapt their devices. The differences between characteristics specific to the threaded necks of the known standards, such as for example the diameter, induce variations of the torque to be applied to an attached device when screwing it onto the threaded neck of a container. There is therefore a problem known to the person skilled in the art within the same threaded neck standard: the identical reproducibility of a threaded neck, for example the diameter, from one bottle to another, is not assured. In other words, two bottles with threaded necks to the same standard can have slightly different geometries and therefore necessitate different screwing torques in order to obtain optimum screwing. This identical reproducibility problem, within the same standard, arises on changing the material of the container, and also when using the same material, notably for glass containers for which identical reproduction is very complicated. This problem is aggravated by the fact that the GCMI standard tolerates wide dimensional ranges.

There is then, on a line for assembling attached devices to threaded necks, a risk of applying too high a screwing torque to an attached device, which can damage the threaded neck of the container and/or the attached device. The damage to the threaded neck of the container can be reflected in the container breaking or cracks in the structure of the bottle, which can have the consequence of subsequent breaking of the bottle. For its part, the damage to the attached device can generate a loss of seal of the combination comprising the bottle and the attached device.

One envisaged solution consists in adapting the screwing torque applied on the assembly line to each change of container threaded neck and attached device standard, in order to determine a threshold screwing toque suitable for all possible variations of threaded necks conforming to the same standard. This solution has the disadvantage of necessitating a lengthy adjustment for the empirical determination of the appropriate screwing torque, during which adjustment the assembly line is greatly slowed down, or even stopped, which is reflected in a reduced overall efficiency of the assembly line. Moreover, this period for determining the appropriate screwing torque must be repeated on each change of container threaded neck standard, or even for each new batch of bottles used.

In the patent application FR3021636, it has already been envisaged to equip an attached device, made up of two rings, one internal, the other external, with means for rotational coupling of these rings releasable by axial relative movement between the rings. In one of the embodiments described, the outer ring has multiple frangible abutments cooperating with teeth provided on the inner ring to couple the internal and outer rings in rotation. These frangible abutments can be retracted by deforming when a threshold torque is applied when screwing the inner ring onto the threaded neck. However, a device of this kind cannot prevent with certainty overscrewing of the inner ring to the threaded neck of the container. To the contrary, such overscrewing is even encouraged in the above application. Therefore, uncertainty with regard to the coupling means breaking for a threshold screwing torque can have the consequence of excessive screwing, which leads to damage to the threaded neck of the container, as explained above, but also in some cases to non-optimum screwing, which does not enable the coupling means to be broken and therefore offers the possibility of unscrewing the attached device using the outer ring. Such a possibility of unscrewing the device using the outer ring may be contrary to the regulations on secure closure systems applied to certain pharmaceutical products, commonly termed child-resistant closures (CRC). Moreover, by intentionally or unintentionally exerting a certain axial pressure between the two rings, it is possible to force the coupling between the internal and outer rings, and therefore to render possible the removal of the attached device from the threaded neck.

SUMMARY OF THE INVENTION

An object of the invention is to remedy these disadvantages by providing an attached device for a threaded neck of a container, the attached device comprises a first ring provided with a screwthread that enables the first ring to be screwed onto a threaded neck of a container and a second ring, constrained to rotate with the first ring with the aid of at least one coupling member separate from at least one of said first and second rings and that comprises at least one coupling zone with the at least one first, second ring from which it is separate. The attached device according to the invention is characterized in that the coupling member comprises at least one rupture zone separate from said coupling zone, designed to break from a threshold rotation torque applied between said first and second rings when a certain torque is applied to the second ring during screwing of the attached device onto the threaded neck of the container.

In the present description, the expression "first, second ring" means "first ring or second ring".

The device according to the invention therefore makes it possible to dissociate the coupling and rupture zones. The coupling means of the attached device according to the invention rupture with great precision when a certain torque is applied to the second ring, because the resultant of the forces exerted on the coupling zone, because of the resistance to screwing that opposes the rotation torque imposed on the attached device, is designed to be transferred to the rupture zone of the coupling member. Because of this, to ensure the coupling means rupture for a predefined rotation torque, it is no longer necessary to take into account partial rupture or deformation of the coupling zones in reciprocal bearing engagement with one of the first and second rings, as is the case for an attached device according to the prior art, in which the coupling zone and the rupture zone coincide.

This rupture obtained with certainty, as soon as the threshold rotation torque is reached, makes it possible to assure both optimum screwing of the attached device to the threaded neck of the container and protection of the bottle against breaking. In fact, rupture of the coupling means leads to the decoupling in rotation of the first ring and the second ring, which enables the second ring to turn freely relative to the first ring. It is then impossible to screw the inner ring of the attached device further onto the threaded neck of the container by applying a torque to the second ring, which protects the bottle and/or the attached device against breaking caused by excessively forceful screwing of the attached device. After decoupling of the first and second rings, even an axial pressure exerted to attempt to move the rings toward one another cannot achieve the rotational coupling thereof. It is therefore impossible to unscrew the first ring and remove the attached device from the threaded neck.

In this application, by the adjective "separate" is meant an absence of a volume of a material in common. In other words, any member or any zone separate from another member or another zone shares no volume of material with that other member or that other zone.

The threshold rotation torque is a predefined rotation torque for a given container threaded neck standard, starting from which the container threaded necks of said standard run a strong risk of being damaged by screwing on the attached device. In other words, the threshold rotation torque is specific to each threaded neck standard.

The elements of an attached device according to the invention can be produced by any known molding process, preferably by an injection molding process. They can consist of any material appropriate to such processes, preferably polyethylene (PE), high-density polyethylene (HDPE) and polypropylene (PP).

The coupling member is advantageously in one piece with the ring from which it is not separate. The one-piece assembly comprising the coupling member and the ring can be produced by the processes and from the materials referred to.

The coupling member of an attached device according to the invention consists at the very least of a coupling zone and a rupture zone separate from the coupling zone. The rupture zone of the coupling member is adapted to break when it is subjected to the resultant of too high a rotation torque applied between the first ring and the second ring, i.e. on application, to the attached device, of a rotation torque that reaches or exceeds the threshold rotation torque at which the coupling member is designed to rupture.

The coupling member is advantageously disposed around the first ring provided with the thread.

Even more advantageously, the coupling member comprises a ring the diameter of which is greater than the outside diameter of the first ring and less than the outside diameter of the second ring, it being understood that the diameters concerned are measured at the height of the ring.

The at least one coupling zone of the coupling member that enables the coupling between the coupling member and the first, second ring the coupling member of which is separate, can comprise any known means enabling rotational fastening of the attached device, as a whole, during the assembly of said attached device. By way of nonlimiting example, the coupling zone of the coupling member comprising at least one tooth adapted to lodge in an orifice or a bore of the first, second ring the coupling member of which is separate, can be envisaged.

The at least one rupture zone of the coupling member in which the rupture between the coupling member and the first, second ring in one piece with the coupling member occurs is not necessarily limited to the exact location of the coupling member at which the rupture occurs. It can comprise any known means allowing the required rupture. By way of nonlimiting example, such means can be a frangible bridge, preferably a plurality of frangible bridges, arranged around the first, second ring with which the coupling means are in one piece, the shape of these bridges enabling rupture thereof to be assured when a rotation torque equal to or greater than the predefined threshold rotation torque is applied. Such means can also comprise one or more tongues of material connecting the first, second ring and the coupling member, such tongues are designed so that all are torn when a rotation torque equal to or greater than the predefined threshold rotation torque is applied to the attached device.

The exact place on the coupling member where the rupture occurs can be situated anywhere in the rupture zone. For example, this exact place can also be situated:

- equidistantly from the first, second ring and the rest of the coupling member,
- as close as possible to the first, second ring, or
- as close as possible to the rest of the coupling member.

In one particular embodiment, the attached device comprises a pump for dispensing a fluid dipping into the container carried by the first ring.

In another particular embodiment, the second ring completely surrounds the first ring provided with the thread, so that it is impossible to access the first ring once the attached device is on the threaded neck of the container. Because of this, once the rupture zone of the coupling member is broken, it is impossible to exert any rotation force on the first ring, this making secure the screwing of the first ring onto the threaded neck. Consequently, it becomes impossible to overscrew or to unscrew the first ring.

In an attached device according to a first embodiment of the invention, the latter comprises a first ring provided with a screwthread, a second ring and a coupling member, in one piece with the first ring that enables the first and second rings to be constrained to rotate together. According to the first embodiment of the invention, the coupling member may consist of a ring of slightly greater diameter than the outside diameter of the first ring, to which it is connected, in one piece, by at least one frangible means. This ring is also made up of at least one means enabling coupling with the second ring. In this way, when a rotation torque greater than the defined threshold torque is applied to the attached device, the frangible means break. This rupture of the frangible means has the consequence of separation of the ring from the coupling means and from the first ring. Because of this, the ring, which is still coupled to the second ring, continues to be constrained to rotate with the second ring and therefore to turn when a rotation torque is applied to the attached device via the second ring but no longer drives the first ring, which remains immobile.

In an attached device according to a second embodiment of the invention, the coupling member is in one piece with the second ring and not with the first ring, as is the case in the first embodiment described above. The attached device according to the second embodiment then comprises a first ring provided with a screwthread, a second ring and a coupling member, in one piece with the second ring, which enables the first and second rings to be constrained to rotate together. The coupling member according to the second embodiment of the invention can consist of a ring of slightly greater diameter than the outside diameter of the second ring to which it is connected, in one piece, by at least one frangible means, this ring also consisting of at least one means enabling coupling with the first ring. In this way, when a rotation torque greater than the defined threshold torque is applied to the attached device, the frangible means break. This rupture of the frangible means has the consequence of separation of the ring from the coupling means and from the second ring. Because of this, the first ring and the ring, which are still coupled and constrained to rotate together, remain immobile when a rotation torque is applied to the attached device via the second ring.

The second ring is advantageously a child-resistant closure (CRC) ring designed to be combinable with a child-resistant closure (CRC) cap. Because of this, there is added to the impossibility of unscrewing referred to, the advantage procured by a CRC cap, namely a safety feature to prevent access of a child to the pump. The bottle-cap assembly then becomes completely impossible for a child to open.

The invention also consists in a method of assembling attached devices, such as those described above, to container threaded necks, the method comprising the application of a screwing torque to the attached devices, characterized in that the screwing torque applied is greater than or equal to a threshold rotation torque, the threshold rotation torque being predefined as a function of the standard covering the container threaded necks to be assembled.

The method therefore has the advantage of offering great repeatability, when it is applied on an assembly line, without it being necessary to consider whether the rotation torque applied risks overscrewing that can damage the bottle and/or the attached device. Because of this, as soon as the threshold rotation torque is programmed as a function of the standard governing the container threaded necks to be assembled, the assembly line no longer needs to be stopped or slowed down because the container threaded necks have slight differences from one container threaded neck to another, which makes it possible to ensure that the assembly line is highly efficient.

The invention also consists in a bottle comprising an attached device as described above and a threaded neck container.

BRIEF DESCRIPTION OF THE DRAWINGS

The invention will be better understood on reading the appended figures, which are provided by way of nonlimiting example, in which.

DETAILED DESCRIPTION OF THE INVENTION

Figure 1:
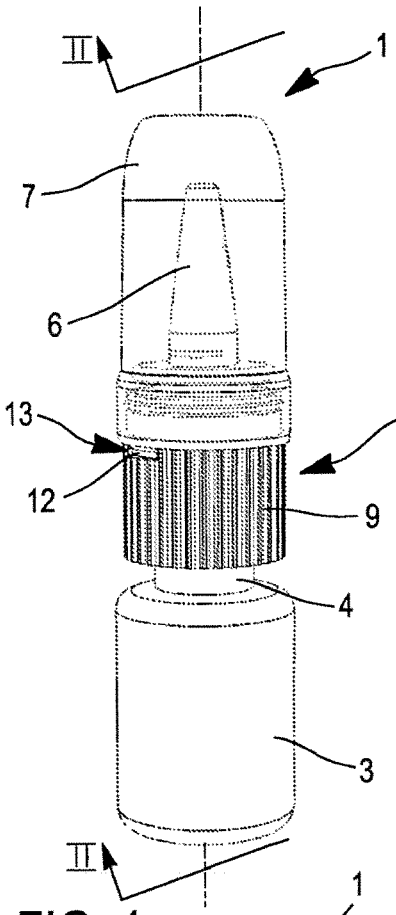
FIG. 1 shows a bottle comprising an attached device in accordance with a first embodiment.

Refer now to FIG. 1, which shows a bottle 1 comprising an attached device 2, in accordance with a first embodiment of the invention, and a container 3 with a threaded neck 4. The attached device 2 comprises a first ring 8 (visible in FIG. 2), in one piece with a coupling member 10 (shown in FIG. 3*a*), a second ring 9, which completely surrounds the first ring 8, a dispensing pump 5 with a tip 6 and a cap 7. The cap 7 is clipped onto the second ring 9, which to this end includes a clipping bead 9*a* (visible in FIGS. 3*b* and 4). During manipulation of the attached device 2 to mount it on the threaded neck 4, the attached device 2 can be held by the cap 7 or by the striated external face of the second ring 9. In both cases, the assembly consisting of the cap 7 and the second ring 9 is considered a unitary assembly, because of clipping one to the other, and any screwing torque applied to the cap 7 amounts to a screwing torque applied to the second ring 9 and vice versa.

The coupling member 10 comprises two coupling zones with the second ring 9, each consisting of a tooth 12 with a beveled free end, that will be designated hereinafter an "oriented clip", adapted to lodge in an orifice 13 of the second ring 9.

Figure 2:
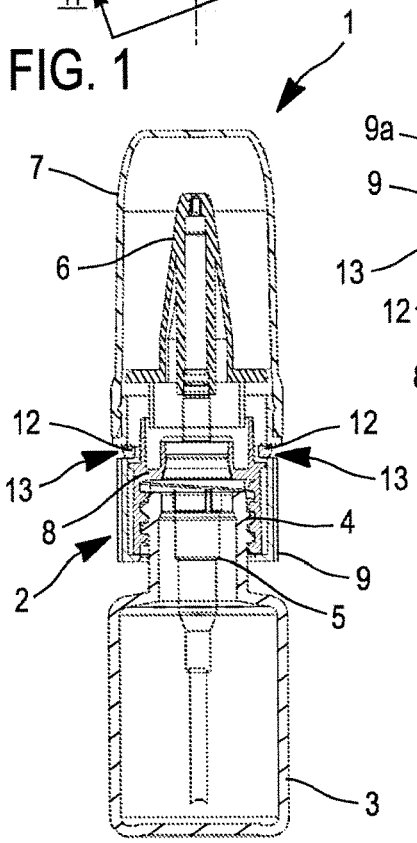
FIG. 2 is a cross section of the bottle shown in FIG. 1 taken along the line II-II.

In FIG. 2 can be seen the attached device 2 screwed completely onto the container 3, thanks to the threaded first ring 8, which is screwed onto the threaded neck 4 of the container 3. The first ring 8 is in one piece with the coupling member 10, which comprises the oriented clips 12 each lodged in an orifice 13 of the second ring 9. The two oriented clips 12 therefore provide the coupling with the second ring 9, the effect of which is to fasten together in rotation the whole of the attached device 2. Each oriented clip 12 therefore defines a coupling zone.

Figure 3A:
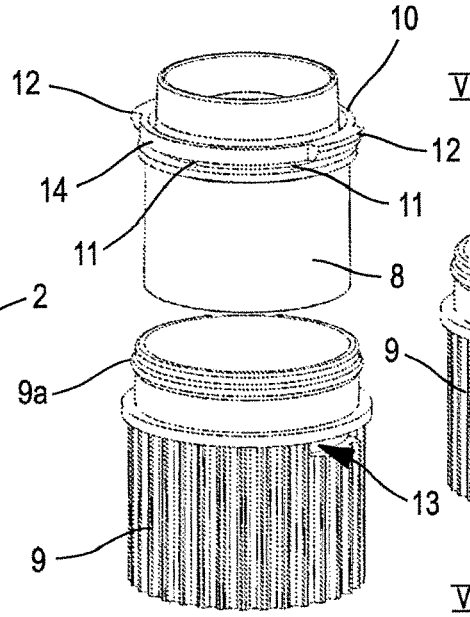
FIGS. 3*a* and 3*b* show a first ring in one piece with a coupling member and a second ring of an attached device according to the first embodiment.

FIG. 3*a* shows the first ring 8, in one piece with the coupling member 10, and the second ring 9, before coupling the first and second rings 8 and 9. The coupling member 10 comprises a plurality of rupture zones separate from the two coupling zones. In the embodiment described, these rupture zones consist of six frangible bridges 11 distributed around the first ring 8, the frangible bridges 11 being adapted to break from a threshold rotation torque applied between said first and second rings 8 and 9. Finally, the coupling member 10 also comprises a ring 14 of greater diameter than the outside diameter of the first ring 8 and smaller diameter than the outside diameter of the second ring 9, which provides the connection between the rupture zones of the coupling member 10 and the coupling zones of the coupling member 10.

Figure 3B:
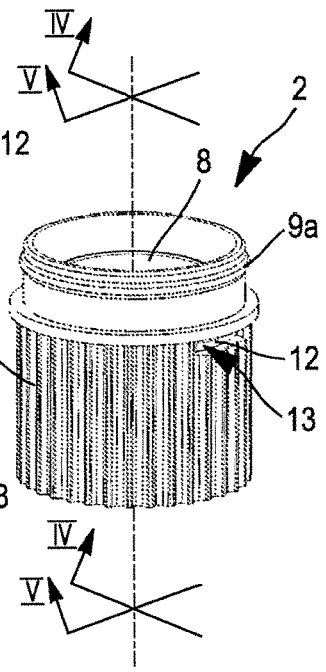

FIG. 3*b* shows the first ring 8 in one piece with the coupling member 10 and the second ring 9 after insertion of the first ring 8 in the second ring 9 and coupling them by clipping them together by clipping the oriented clips 12 inside the orifices 13.

Figure 4:
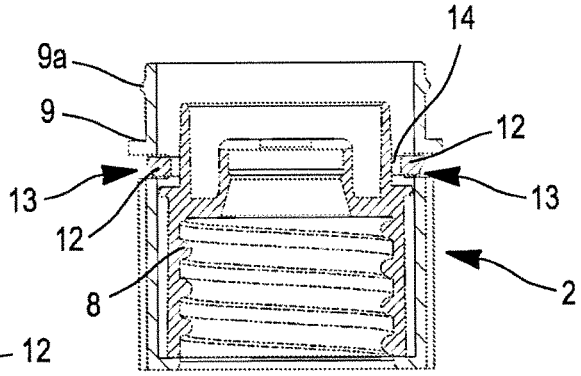
FIGS. 4 and 5 are two cross sections taken along the lines IV-IV and V-V, respectively, in FIG. 3*b*.
Figure 5:
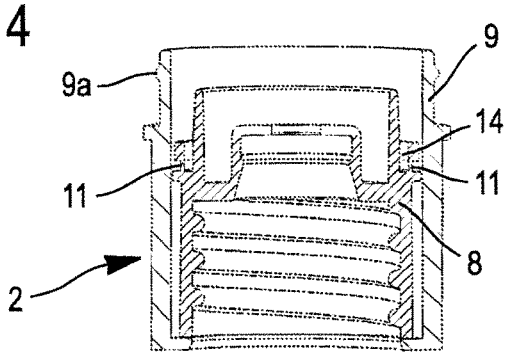

In FIGS. 4 and 5, it is possible to observe in greater detail the coupling between the first ring 8 provided with a screwthread, enabling screwing onto the threaded neck 4 of the container 3, and the second ring 9, thanks to the oriented clips 12 of the ring 14 that is connected to the first ring 8 by the frangible bridges 11. Frangible bridges 11 of this kind are able to break starting from a predefined threshold rotation torque applied between said first and second rings 8 and 9.

FIGS. 6*a*, 7*a*, 8*a* and 9*a* show various steps in the assembly of an attached device 2 from FIGS. 1 to 5 onto a container 3. Each of the assembly steps shown in FIGS. 6*a*, 7*a*, 8*a* and 9*a* is to be analyzed in conjunction with the corresponding cross section, shown in FIGS. 6*b*, 7*b*, 8*b* and 9*b*. Those cross sections are taken along the line VI-VI present in each of FIGS. 6*a*, 7*a*, 8*a* and 9*a*. For greater clarity, the cap 7 and the second ring 9 are intentionally concealed in the figures but as the coupling member 10 is clipped into the second ring 9, any screwing torque applied to the attached device 2 from the outside, i.e. to the cap 7 or to the second ring 9, is applied to the coupling member 10.

Figure 6A:
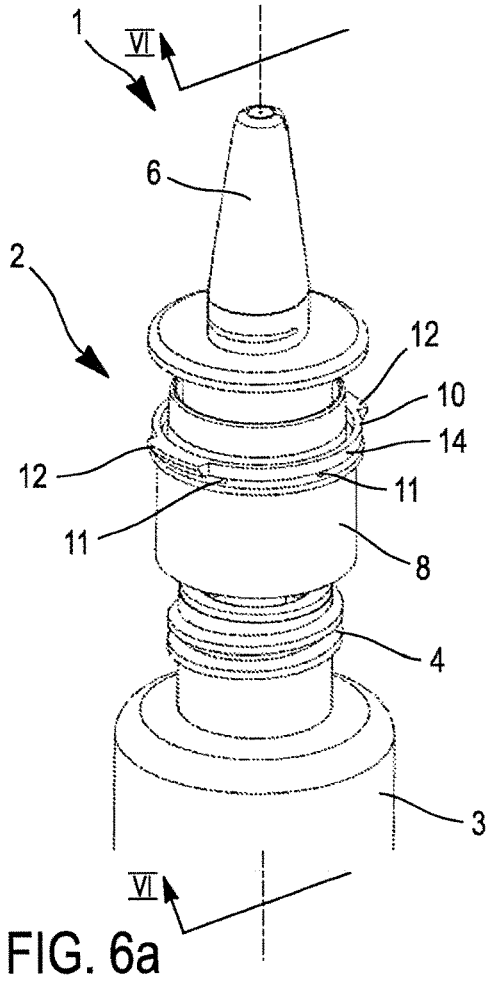
FIGS. 6*a*, 7*a*, 8*a* and 9*a* show four different steps of a method of assembling an attached device, in accordance with the first embodiment, to a container threaded neck (the cap and the second ring being intentionally concealed).
Figure 6B:
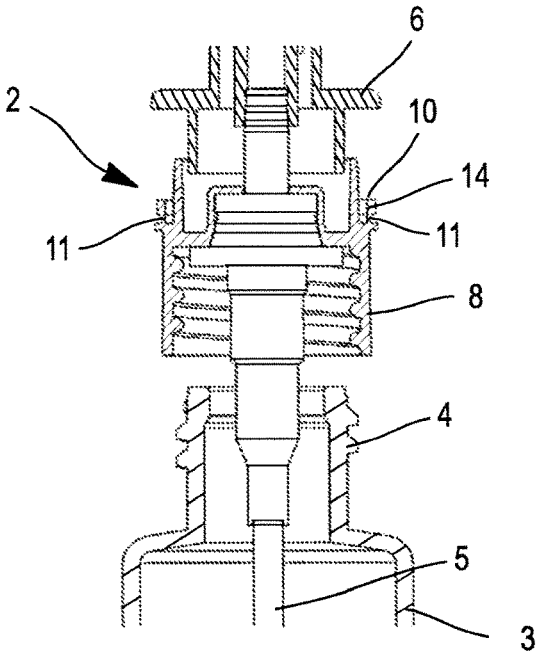
FIGS. 6*b*, 7*b*, 8*b* and 9*b* are cross sections taken along the line VI-VI of the assembly from FIGS. 6*a*, 7*a*, 8*a* and 9*a*, respectively (the cap and the second ring being intentionally concealed).

FIGS. 6*a* and 6*b* show an unassembled bottle 1, before the attached device 2 comes into contact with the threaded neck 4 of the container 3. During this assembly step, which aims to produce the bottle 1 from FIG. 1, no screwing torque has yet been applied to the attached device 2. Thus no rupture of the frangible bridges 11 can be envisaged and the first ring 8 remains in one piece with the coupling member 10. Consequently, the first ring 8 also continues to be constrained to rotate with the second ring 9 (not shown in these figures), thanks to the oriented clips 12 of the coupling member 10 positioned in the orifices 13 of the second ring 9 of the attached device 2.

Figure 7A:
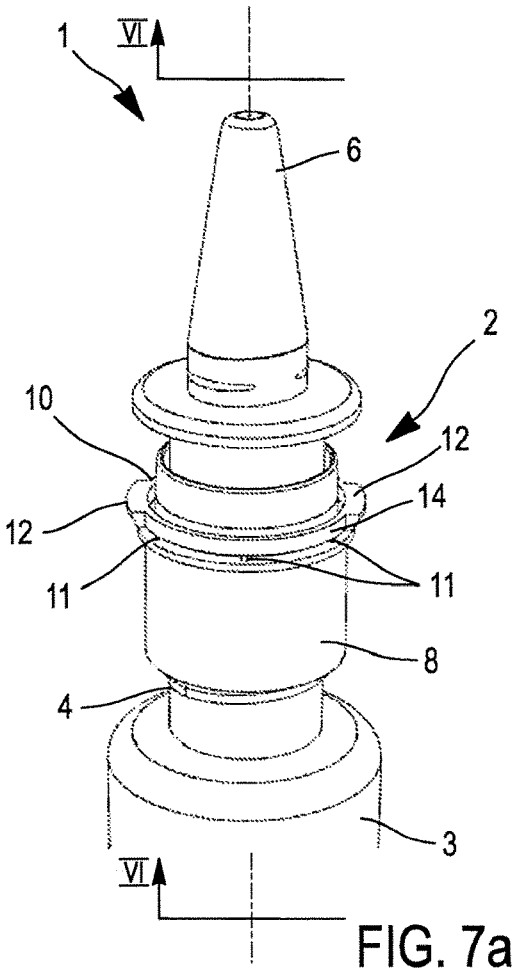
Figure 7B:
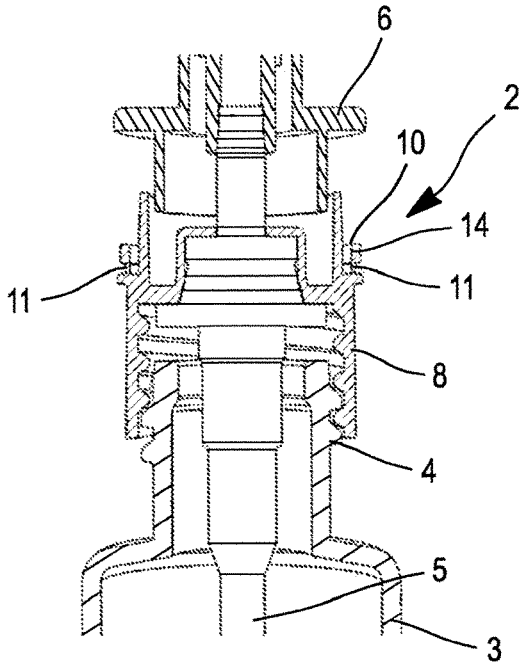

FIGS. 7*a* and 7*b* show the bottle 1 during assembly. The attached device 2 is starting to be screwed onto the threaded neck 4 of the container 3. During this assembly step that aims to produce the bottle 1 from FIG. 1, a screwing torque is applied to the attached device 2 and therefore to the coupling member 10. As the first ring 8 does not encounter any obstacle while it is being screwed onto the threaded neck 4, apart from friction, the rotation torque applied between the first and second rings 8 and 9 is equal to the resisting torque caused by friction. This rotation torque is not yet greater than or equal to the predefined threshold rotation torque. As for the previous step, no rupture of the frangible bridges 11 can then be envisaged and the first ring 8 remains in one piece with the coupling member 10. Consequently, the first ring 8 also continues to be constrained to rotate with the second ring 9 (not shown in these figures), thanks to the oriented clips 12 of the coupling member 10 positioned in the orifices 13 of the second ring 9 of the attached device 2.

Figure 8A:
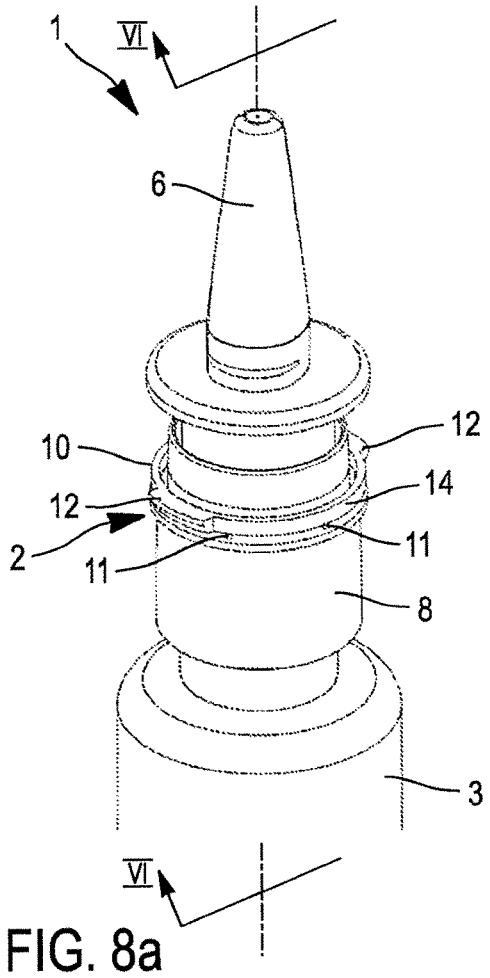
Figure 8B:
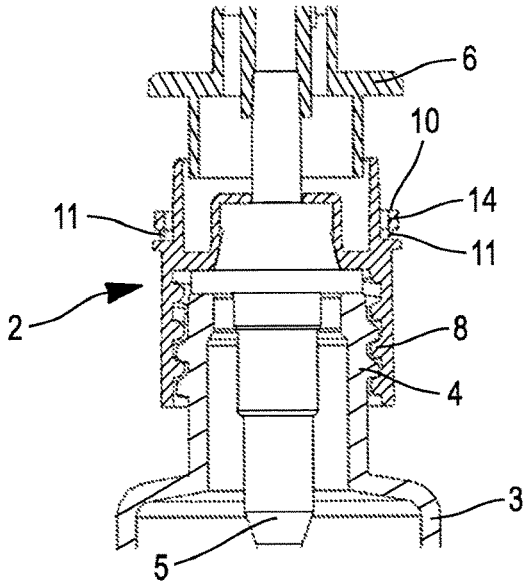

FIGS. 8*a* and 8*b* show the bottle 1 during assembly. The attached device 2 is close to the end of screwing it onto the threaded neck 4 of the container 3. At this stage of assembly, the first ring 8 encounters a force resisting rotation as it is screwed onto the threaded neck 4 and the rotation torque between the first and second rings 8 and 9 is equal to the resisting torque opposed by the threaded neck 4. However, the resultant of the forces transferred to the frangible bridges 11 has not reached the threshold at which the frangible bridges 11 break. As before, no rupture of the frangible bridges 11 then occurs, the first ring 8 remains in one piece with the coupling member 10 and also continues to be constrained to rotate with the second ring 9 (not shown in these figures), thanks to the oriented clips 12 of the coupling member 10 positioned in the orifices 13 of the second ring 9 of the attached device 2.

Figure 9A:
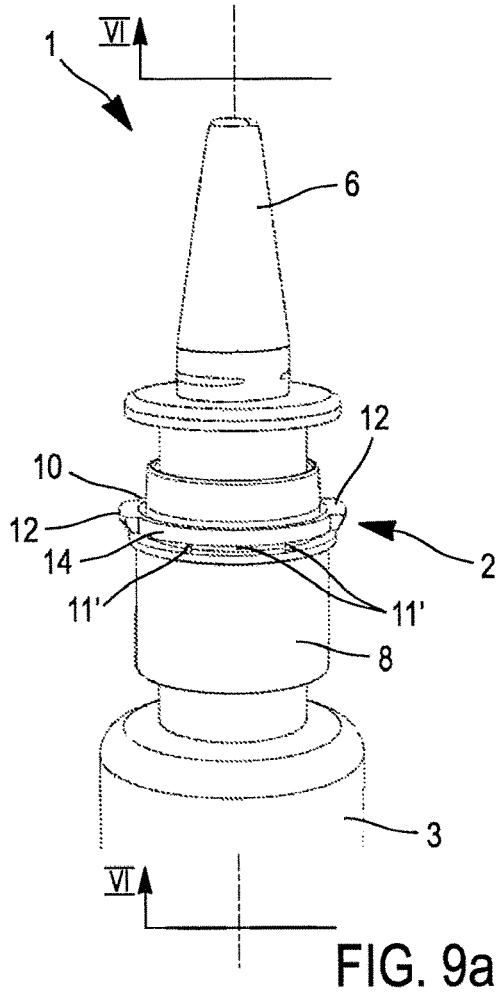
Figure 9B:
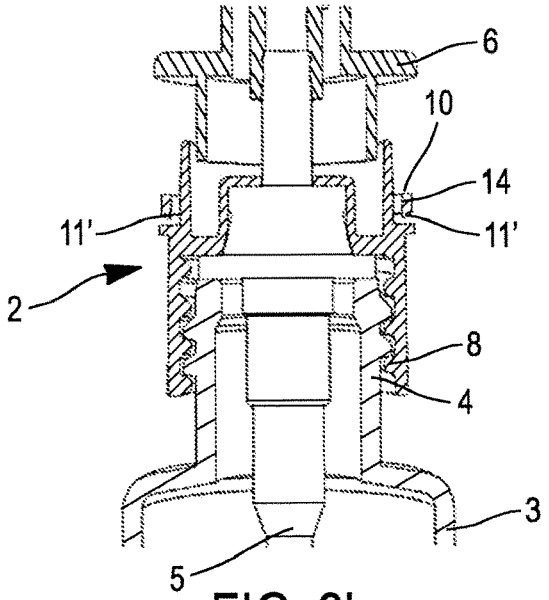

FIGS. 9*a* and 9*b* show the bottle 1 at the end of assembly. To finish with the production of the bottle 1, shown in this step, the rotation torque applied between the first and second rings 8 and 9 has suddenly increased after screwing the attached device 2 completely onto the threaded neck 4 of the container 3. The maximum possible rotation torque is equal to the screwing torque. This possible maximum is greater than or equal to the predefined rotation torque starting from which the frangible bridges 11 of the rupture zone of the coupling member 10 are designed to break. In other words, the resultant of the forces exerted on the two coupling zones of the coupling member 10, because of the rotation torque imposed on the attached device 2, transferred to the frangible bridges 11 of the coupling member 10, has passed the threshold starting from which the frangible bridges 11 break. The frangible bridges 11 are then broken and form half-bridges 11'. Consequently, the first ring 8 is no longer in one piece with the ring 14 of the coupling member 10, which continues to be coupled to the second ring 9, via the oriented clips 12. The first ring 8 is therefore no longer constrained to rotate with the second ring 9 (not shown in these figures) which therefore turns freely around the first ring 8. In other words, when a rotation torque, in the screwing or unscrewing sense, is applied to the attached device 2, via the second ring 9, the first ring 8 is not entrained by the rotation of the second ring 9, even if an axial force is exerted in an attempt to move the first and second rings 8, 9 toward one another. Because the second ring 9 completely surrounds the first ring 8, it is moreover then impossible to overscrew the first ring 8 onto the threaded neck 4 of the container 3 or to unscrew it therefrom.

According to a variant embodiment not shown, these orifices 13 could be blocked by the exterior wall of the second ring 9 instead of open-ended. Regardless of the embodiment, these oriented clips 12 are inoperative to detach the first ring 8 from the threaded neck 4 of the container 3.

Figure 10:
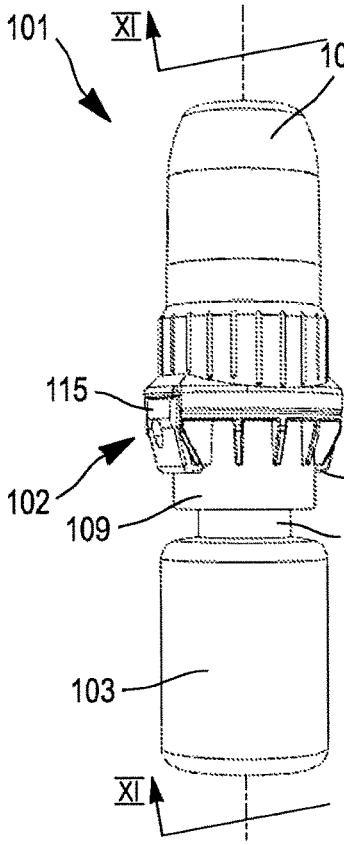
FIG. 10 shows a CRC bottle comprising a CRC attached device in accordance with a first embodiment.
Figure 11A:
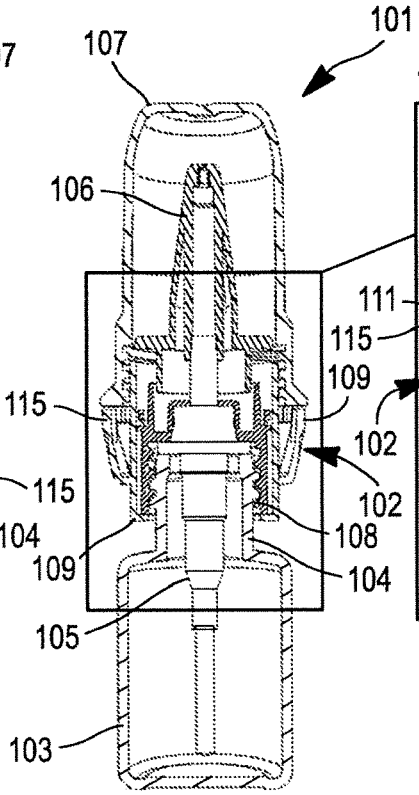
FIG. 11*a* is a cross section of the bottle shown in FIG. 10 taken along the line XI-XI.
Figure 11B:
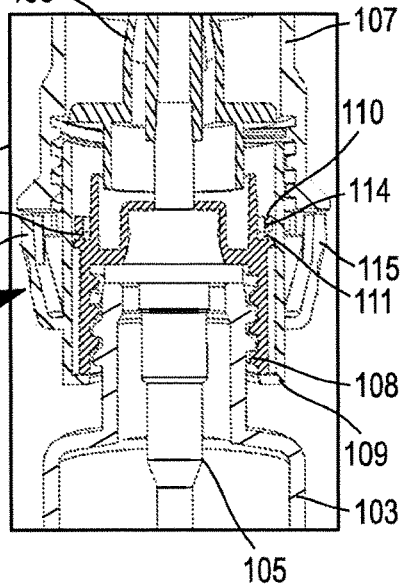
FIG. 11*b* shows an enlargement of the section shown in FIG. 11*a*.

FIG. 10 shows a CRC bottle 101 that comprises a CRC attached device 102 according to the first embodiment of the invention and a container 103 with threaded neck 104. As shown in FIGS. 11*a* and 11*b*, the CRC attached device 102 comprises a dispensing pump 105 including a tip 106, a CRC cap 107, a first ring 108 in one piece with a coupling member 110, and a second ring 109 that completely surrounds the first ring 108. The coupling member 110 comprises two coupling zones with the second ring 109, each consisting of an oriented clip 112 adapted to be lodged in an orifice 113 of the second ring 109. The second ring 109 of the CRC attached device 102 comprises a screwthread, enabling screwing on of the CRC cap 107, and two external clips 115, enabling secure coupling between the CRC cap 107 and the second ring 109. In other words, in addition to the impossibility of dissociating the CRC attached device 102 from the container 103, once the cap 107 is screwed onto and coupled to the second ring 109 of the CRC attached device 102, it is extremely complicated, and preferably impossible, for a child to dismount the cap 107 from the second ring 109. Consequently, the pump 105 and the contents of the bottle 101 become inaccessible to a child.

In FIG. 11*a* there can be seen the CRC attached device 102, screwed completely onto the container 103 thanks to the first ring 108 including a screwthread, which is screwed onto the threaded neck 104 of the container 103. The first ring 108 is in one piece with the coupling member 110, which comprises the two oriented clips 112 each housed in an orifice 113 of the second ring 109. The two oriented clips 112 provide the coupling with the second ring 109, the effect of which is to fasten together in rotation all of the CRC attached device 102.

FIG. 11*b* shows an enlargement of the section shown in FIG. 11*a*, more particularly showing the screwing zone between the CRC attached device 102 and the container 103. It is possible to observe the arrangement of the frangible bridges 111 and the ring 114 of the coupling member 110, as well as the external clips 115 of the second ring 109.

Figure 12A:
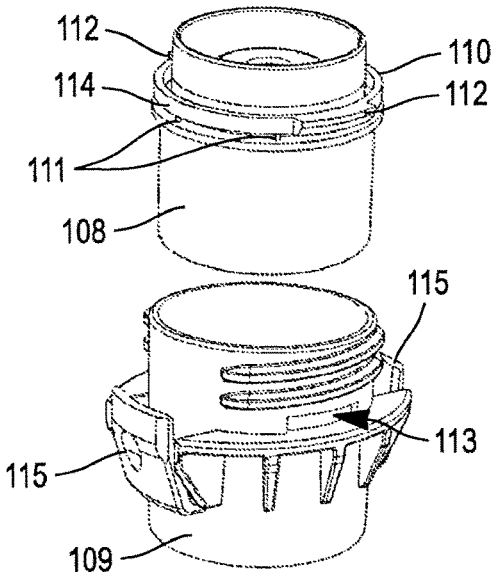
FIGS. 12*a* and 12*b* show a first ring in one piece with a coupling member and a second ring of the CRC attached device from FIGS. 10 to 11*b*.

FIG. 12*a* shows the first ring 108, in one piece with the coupling member 110 and the second ring 109, before coupling the first and second rings 108 and 109. The coupling member 110 comprises a rupture zone, separate from the two coupling zones, that, in the embodiment described, consists of six frangible bridges 111 distributed around the first ring 108 and adapted to break starting from a threshold rotation torque applied between said first and second rings 108 and 109. Finally, the coupling member 110 also comprises a ring 114 of diameter greater than the outside diameter of the first ring 108 and less than the outside diameter of the second ring 109, which provides the connection between the rupture zone of the coupling member 110 and the two coupling zones of the coupling member 110. Finally, the second ring 109 of the CRC attached device 102 comprises two external clips 115 that enable a secure coupling between the CRC cap 107 and the second ring 109.

Figure 12B:
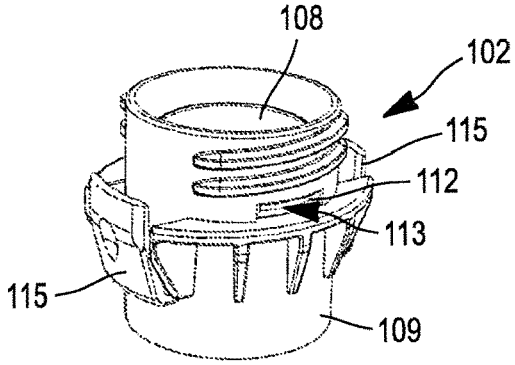

FIG. 12*b* shows the first ring 108 in one piece with the coupling member 110 and the second ring 109 after insertion of the first ring 108 in the second ring 109 and coupling them together by clipping the oriented lugs 112 inside the orifices 113.

The invention is not limited to the embodiments described and other embodiments will be clearly apparent to the person skilled in the art.

1,101 bottle
2, 102 attached device
3, 103 container
4, 104 threaded neck
5, 105 dispensing pump
6, 106 tip
7, 107 cap
8, 108 first ring
9, 109 second ring
9*a* clipping bead
10, 110 coupling member
11, 111 frangible bridges
11' half-bridges
12, 112 tooth (oriented clip)
13, 113 orifice
14, 114 ring
105, 11 external clips

The invention claimed is:

1. An attached device for a threaded neck of a container, the attached device comprising a first ring provided with a screwthread that enables the first ring to be screwed onto a threaded neck of a container and a second ring, constrained to rotate in either direction with the first ring with the aid of at least one coupling member separate from at least one of said first ring and said second rings and that comprises at least one coupling zone with the at least one of said first ring and said second ring, from which said at least one coupling member is separate, wherein the coupling member comprises at least one rupture zone separate from said coupling zone, designed to break from a threshold rotation torque applied between said first and second rings when a certain torque is applied to the second ring during screwing of the attached device onto the threaded neck of the container.

2. The attached device according to claim 1, wherein the coupling member comprises a ring the diameter of which is greater than the outside diameter of the first ring and less than the outside diameter of the second ring.

3. The attached device according to claim 2, wherein the coupling zone of the coupling member comprises at least one tooth adapted to be lodged in an orifice or a bore of the first ring or the second ring, the coupling member of which is separate.

4. The attached device according to claim 1, wherein the rupture zone of the coupling member comprises at least one frangible bridge arranged around the first ring or the second ring in one piece with the coupling member.

5. The attached device according to claim 1, further comprising a pump carried by the first ring for dispensing a fluid.

6. The attached device according to claim 1, wherein the second ring completely surrounds the first ring so that it is impossible to access the first ring.

7. The attached device according to claim 1, wherein the second ring is a child-resistant-closure (CRC) ring designed to be combinable with a child-resistant-closure (CRC) cap.

8. A method of assembling attached devices according to claim 1, to threaded necks of a container, the method comprising the application of a screwing torque to the attached devices, wherein the applied screwing torque is greater than or equal to a threshold rotation torque.

9. A bottle comprising an attached device according to claim 1 and a container with a threaded neck.

10. The attached device according to claim 1, wherein the coupling zone of the coupling member comprises at least one tooth adapted to be lodged in an orifice or a bore of the first ring or the second ring, the coupling member of which is separate.

* * * * *